US008597162B2

(12) United States Patent
Amonette et al.

(10) Patent No.: US 8,597,162 B2
(45) Date of Patent: Dec. 3, 2013

(54) APPARATUS TO FACILITATE UPRIGHT POSTURE

(75) Inventors: William E. Amonette, Houston, TX (US); Kirk L. English, Houston, TX (US); William L. Buford, Jr., Galveston, TX (US); Billy W. Amonette, Houston, TX (US)

(73) Assignee: Board of Regeants, The University of Texas System, Austin, TX (US)

( * ) Notice: Subject to any disclaimer, the term of this patent is extended or adjusted under 35 U.S.C. 154(b) by 552 days.

(21) Appl. No.: 12/796,447

(22) Filed: Jun. 8, 2010

(65) Prior Publication Data

US 2010/0318005 A1 Dec. 16, 2010

Related U.S. Application Data

(60) Provisional application No. 61/184,942, filed on Jun. 8, 2009.

(51) Int. Cl.
*A63B 21/00* (2006.01)

(52) U.S. Cl.
USPC ..... 482/66; 482/68; 482/67

(58) Field of Classification Search
USPC ..... 482/77, 66, 67, 68, 69, 75
See application file for complete search history.

(56) References Cited

U.S. PATENT DOCUMENTS

| | | | | |
|---|---|---|---|---|
| 2,792,052 | A | 5/1957 | Johannessen | |
| 4,312,505 | A * | 1/1982 | Engelhart | 482/68 |
| 4,461,471 | A | 7/1984 | Brastow | |
| 4,510,956 | A | 4/1985 | King | |
| 4,765,355 | A | 8/1988 | Kent | |
| 4,770,410 | A | 9/1988 | Brown | |
| 5,511,571 | A * | 4/1996 | Adrezin et al. | 135/66 |
| 6,733,018 | B2 | 5/2004 | Razon | |
| 7,275,554 | B2 | 10/2007 | Mullholand | |
| 7,294,094 | B1 | 11/2007 | Howle | |

* cited by examiner

*Primary Examiner* — Jerome W Donnelly
(74) *Attorney, Agent, or Firm* — Wong, Cabello, Lutsch, Rutherford & Brucculeri, LLP

(57) ABSTRACT

A mobility apparatus for a patient permitting improved mobility is disclosed. The apparatus includes a frame assembly, a locomotion assembly, a forearm support assembly, a kinematic and kinetic feedback assembly and optionally a back support assembly, where the apparatus provides mobility assistance, while permitting visualization of movement velocity, loaded and unloaded motion, and other information concerning a patients proper use of the mobility assistance apparatus.

24 Claims, 15 Drawing Sheets

APPARATUS TO FACILITATE UPRIGHT POSTURE

CROSS REFERENCE TO RELATED APPLICATIONS

This application claims priority based on U.S. Provisional Application Ser. No. 61/184,942 filed Jun. 8, 2009 and which is incorporated herein by reference.

FIELD OF THE INVENTION

Embodiments of the present invention relate to a mobility apparatus for improving patient mobility.

More particularly, embodiments of the present invention relate to a mobility apparatus for improving patient mobility, where the apparatus includes a collapsible or non-collapsible frame having feet including rolling units and having slings for engaging the forearms of a patient including weight monitors such as load cells. The apparatus also includes an electronic control unit for monitoring movement, mobility and weight load distribution during apparatus usage by a patient. Additionally, the apparatus includes a velocity sensor, optionally an odometer and optionally other devices for kinematic feedback. Finally, the apparatus includes a back support with a lumbar and cervical belt to improve upright ambulatory posture.

BACKGROUND OF THE INVENTION

Over the last 80 years, the percentage of Americans over the age of 65 has steadily increased. This is due primarily to improvements in the quality and availability of health care, resulting in an increase in the average life span of Americans. With the aging of the "baby boomer" generation, there will be an expected exponential increase in the number of elderly Americans over the next 40 years. The US Census Department predicts the number of elderly Americans to rise from 35 million in 2000 (12% of total population) to 86.7 million in 2050 (20.7% of total population).

With the swelling of the elderly population, comes a concomitant increase in the prevalence of age-related disabilities and diseases. Fifty-four percent (54%) of Americans report at least one disability and 37% report more than one disability. The number of Americans reporting disabilities increases each decade of life after the 5th decade. Almost all elderly Americans report having been diagnosed with one of the following conditions: hypertension, arthritis, heart disease, cancer, diabetes, or sinusitis. Most of these subjects are reported having more than one of the above conditions.

This is of great importance due to the rising cost of health care and reduced income associated with aging. It has been reported that 33% of Americans over the age of 65 derive 90% of their total income from Social Security. All but 1% of elderly Americans have some form of health insurance, but in 2003 they paid on average of 12.5% of their total income to cover health care expenses. Increased disease and disability rates result in decreased functional capacity, decreased independence, and consequently the need to hire home health care or to move into nursing homes. In 1999, 10.5 out of every 1000 Americans between the ages of 65-74 lived in nursing homes. The number of nursing home residents increases relative to age for elderly Americans between the ages of 75-84 yrs. (41 out of 1000) and 85-94 yrs. (163.5 out of 1000). Living in a nursing home or hiring home healthcare are both associated with a decreased level of physical activity.

Aside from disease and disability, normal aging results in decreases in strength, balance control, gait velocity, and changes in gait mechanics. These decreases have a profound impact on elders' ability to ambulate which in turn dictates their functional capabilities and ultimately, their level of independence. Assistive technologies such as walkers are often employed to prevent pathologies and impairments from causing functional limitations. The common walker is designed such that users support themselves by interfacing with the walker through their hands and wrists. Walkers are intended to provide bilateral balance support and mild to moderate off-loading of an individual's body weight. Thus, users should push a walker along as they maintain a relatively normal walking speed; however, most either walk at a reduced velocity or actually lift and set down the walker with every step. The effects are altered gait mechanics and decreased gait velocity which is independently associated with increased deficits in instrumental activities of daily living (IADL) and activities of daily living (ADL).

Along with aging, other permanently or temporarily disabled individuals rely on walking aids for ambulation. For example, patients with a traumatic brain injury may need walking assistance for life to avoid further injury resulting from falls. Patients with lower extremity orthopedic injuries (e.g. knee or ankle ligament sprain, muscle strain, etc.) may temporarily need the assistance of a walking aid. These populations often rely on the same technology used by the elderly that alters walking speed and may result in increased disability or increased rehabilitation time.

Another problem with traditional walkers is that users often use the device more like a crutch than an aid; they literally rely too heavily on the walker by off-loading a large percentage of their body weight which increases stress and strain through the upper extremities, while simultaneously reducing ground reaction forces that are necessary to maintain lower extremity and trunk musculoskeletal integrity.

Additionally, users often adopt poor posture when using a traditional walker, i.e., greater neck, trunk, and hip flexion as well as increased scapular protraction. Thus, instead of helping the elderly, traditional walkers might actually facilitate functional limitations and disability by decreasing gait velocity, strength, balance control and contributing to poor posture and walking mechanics. Ultimately, these assistive devices then contribute to decreased activity which leads to increased disability.

Current walkers provide: 1) a wheeled device with support provided beneath the user's arms that promotes an upright posture as disclosed and illustrated in FIG. 1 of U.S. Pat. No. 2,792,052; 2) a wheeled device with support provided through either the user's elbows and forearms or the user's hands as disclosed and illustrated in FIG. 2 of U.S. Pat. No. 4,510,956; 3) a wheeled device fully encircling the user and employing handgrip support, optional seating, and a belted restraint system as disclosed and illustrated in FIG. 3 of U.S. Pat. No. 4,770,410; 4) a three wheeled device with support provided via a handrail and in which all structures are in front of the user; i.e., there are no side panels as disclosed and illustrated in FIG. 4 of U.S. Pat. No. 4,765,355; and 5) a fixed wheel device with support provided through the user's hands and employing foldable storage capability as disclosed and illustrated in FIG. 5 of U.S. Pat. No. 4,461,471.

U.S. Pat. No. 7,294,094 discloses a walker design supporting the user by connecting a harness from the user to the walker high on the back. U.S. Pat. No. 7,275,554 discloses a walker design supporting the user near the underarms. U.S. Pat. No. 6,733,018 discloses a walker design supporting the user under the arm by a harness in which the user sits.

Although many and varied solutions to the walker problem have been disclosed, they all have advantages and disadvantages. Thus, there is a continued need in the art for a walker apparatus that alleviates some of the problems with walkers of the prior art, while improving the mobility of patients with temporarily impaired mobility.

SUMMARY OF THE INVENTION

Embodiments of the present invention provide mobility assistance apparatus including a frame assembly, a locomotion assembly, a forearm support assembly, a kinematic and a kinetic feedback assembly (e.g., a velocity sensor, an odometer, etc.), where the apparatus provides mobility assistance, while permitting visualization of movement velocity, loaded and unloaded motion, and other information concerning a patient's proper use of the mobility assistance apparatus.

Embodiments of the frame assembly of this invention include a plurality of vertical members, a plurality of horizontal members, a plurality of joints, and a frame/platform connector disposed on one of the horizontal members. The vertical members and horizontal members are interconnected by the frame joints. The frame/platform connector is adapted to engage a platform/frame connector of the platform of the kinematic feedback assembly. The frame assembly also includes a plurality of frame/locomotion connectors disposed on bottom ends of some or all of the vertical members. The frame assembly also includes frame/monitor connectors disposed on two horizontal members. The frame assembly also includes electrical conduits leading from the mounts to the platform.

Embodiments of the locomotion assembly of the present invention include a plurality of translational units, where each unit includes a rotatable member mounted in a housing including a locomotion/frame connector adapted to detachably engage one of the frame/locomotion connectors.

Embodiments of the forearm support assembly of the present invention include two forearm support units, each unit having a forearm support. The forearm support assembly also includes a unit/monitor connector, a weight monitor (e.g., a load cell or other weight monitoring device) having a cable connector, a monitor/unit connector and a monitor/frame connector. The unit/monitor connector and the monitor/unit connector are adapted to detachably engage and to mount the forearm support units so that the weight monitor measures a weight of the units. The monitor/frame connector is adapted to detachably engage the frame/monitor connectors to support the forearm support assembly on the frame.

Embodiments of the kinematic feedback assembly of the present invention include a platform, a feedback unit, cables, and a platform/frame connector. The feedback unit includes cable connectors, optionally a visual display, optionally a speaker, and a processing unit including a memory and communications hardware and software. The platform/frame connector is adapted to detachably engage the frame/platform connector and to mount the platform onto the frame. The cables of the kinematic feedback assembly connect the weight monitors, optional the velocity sensors, optionally an odometer, and other sensors adapted to monitor patient movement while the patient is using the mobility assistance apparatus to the feedback unit. The feedback unit may also include software designed to analyze patient use of the apparatus and to supply feedback instructions to the patient or to modify the patient's use of the apparatus.

Embodiments of the kinematic feedback assembly may also include wireless communication hardware and software to permit remote feedback to the patient and to send audio and/or visual data, information, and/or signals to a remote site, such as a doctors office, hospital, physical or occupational therapy clinic, patient monitoring center or other type of medical assistance institution. Such data, information, or signals may also be used for remote monitoring of patient progress, patient exercise and usage protocols, etc. The feedback assembly may also be able to provide instructions to the patient for proper use of the apparatus, for changing exercise protocols, etc.

Embodiments of the frame of this invention may be non-collapsible and/or non-adjustable.

Embodiments of the frame of this invention may be collapsible and/or adjustable.

Embodiments of the present invention provide an apparatus including a frame assembly. The frame assembly includes two U-shaped side members, a plurality of horizontal bracing members, a plurality of horizontal back members, a pivotally mounted front member, and a back support mounted on the horizontal back members. The back support includes two posture maintenance straps that can be used individually or together to better facilitate upright posture during ambulation. The apparatus also includes a locomotion assembly, a forearm support assembly, a kinematic and a kinetic feedback assembly (e.g., a velocity sensor, an odometer, etc.), where the apparatus provides mobility assistance, while permitting visualization of movement velocity, loaded and unloaded motion, and other information concerning a patient's proper use of the mobility assistance apparatus.

Embodiments of this invention also provide methods for using the apparatuses of this invention, where the methods include positioning a patient within the frame assembly. The methods also include monitoring the patient's motion using the apparatuses, where the monitoring may include monitoring weight offloading onto the forearm support units, walking velocity, walking velocity and distance, walking posture or other walking aspects. The methods also include feeding back information to the patient to improve use of apparatuses.

BRIEF DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1A:
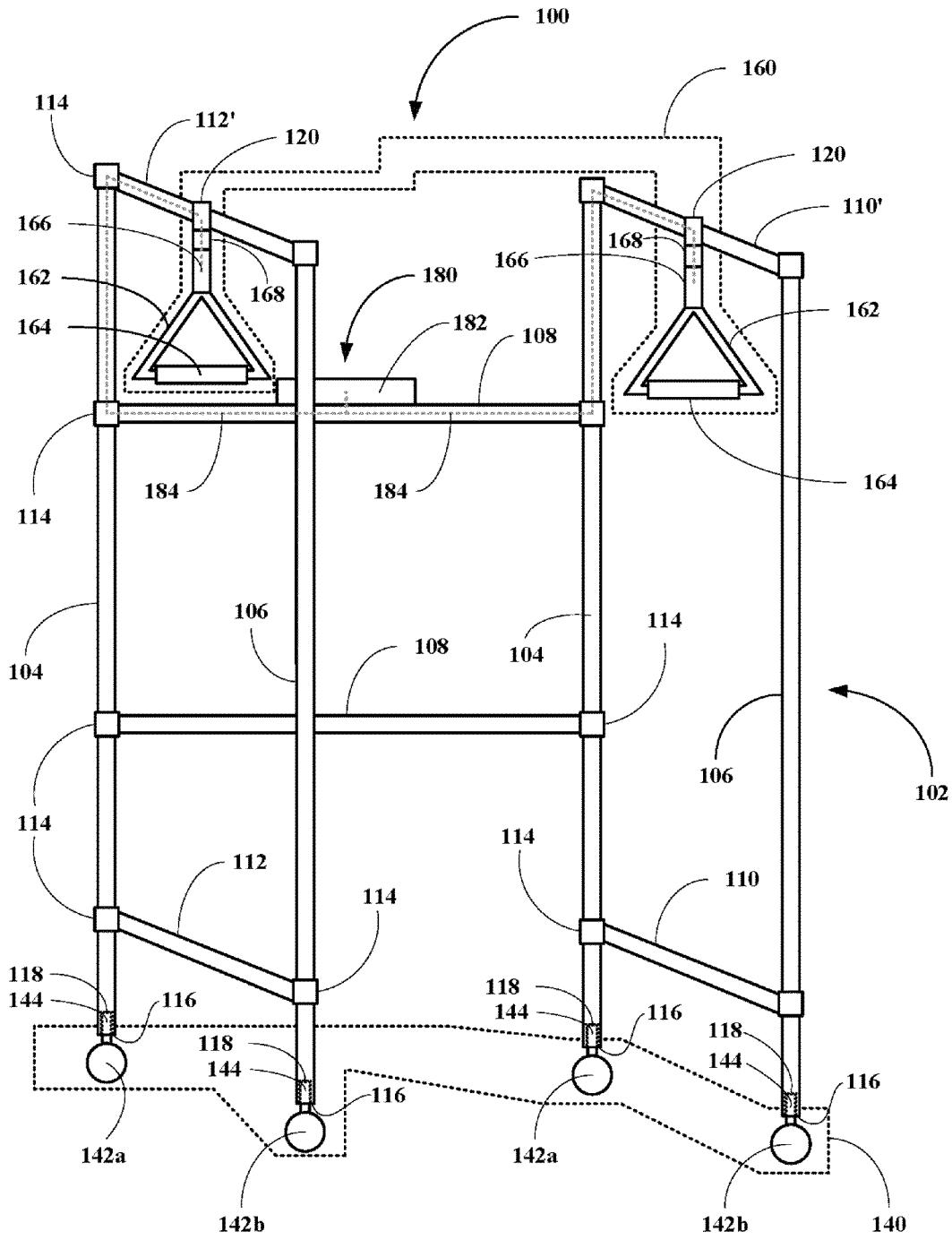
FIG. 1A depicts an embodiment of a mobility assistance apparatus of this invention.

We have developed a mobility apparatus or walker that facilitates both normal gait velocity and an upright posture. In addition to a novel structure that promotes upright posture and creates an improved user interface with the apparatus (kinematic improvements), our mobility apparatus or walker also provides kinetic feedback in the form of weight or force measuring sensors, such as load cells, that measure the force off-loaded through the arms onto the apparatus to provide information to the patient on the amount of weight the patient is off-loading to the apparatus. The apparatus may also include a speedometer or other velocity measuring device to allow patients to monitor their velocity, thus encouraging them to maintain normal walking speeds. In addition, the mobility apparatus or walker apparatus can include an odometer to allow users to monitor distance traveled over a given period of time or during the entire time period that the walker apparatus is used.

Embodiments of the present invention broadly relate to a mobility assistance apparatus including a frame assembly, a locomotion assembly, an forearm support assembly, and a kinematic feedback assembly, where the apparatus provides mobility assistance, while permitting visualization of movement velocity, loaded and unloaded motion, and other information concerning a patient's use of the mobility assistance apparatus and to improve proper use of the apparatus to reduce apparatus usage and to speed recovery.

In certain embodiments, the apparatus frame is constructed of steel, aluminum or rigid plastic or composite pipe having a diameter between about 0.5" to about 1" that forms a four-sided enclosure around a standing user, where a back side is opened for the user to ingress and egress from the apparatus frame. The front side of the apparatus frame includes a gated entry bar that houses the feedback and display units for user kinetic and kinematic feedback. In certain embodiments, apparatus is produced for different heights of the user or the apparatus is adjustable to accommodate various heights of patients or users. The forearm support units are mounted on force measuring units or weight monitors such as Wheatstone bridge load cells. The weight monitors are mounted on a horizontal member by a mounting member such as an eye bolt. Each forearm support unit hangs from a weight monitor (load cell). Each forearm support unit includes a cushioned strap through which the user inserts an arm. The straps are adjustable and are adjusted so that the user's elbows are fixed at an angle to the vertical of about 90°. The pressure from the supported body weight is spread over both straps. The straps are 6" wide and extend from a user's elbows to a user's mid-forearm. Weight monitor (load cell) readings are optionally displayed on a horizontal light panel or display of the feedback unit. As more force is exerted on the load cells, additional cells light up, indicating to the user that they are unloading more of their body weight onto the straps. The feedback unit is fastened to a lateral or horizontal support member or rod at approximately chest height so that its display is readily visible by the user. The frame has wheels disposed on a distal end of each vertical member. In certain embodiments, the frame includes four vertical members and four total wheels, one disposed at the distal end of the four vertical members. In certain embodiments, the front wheels have a 360° freedom of movement to allow for turning and pivoting, while the rear wheels are fixed. In certain embodiments, small magnets are affixed to the rear wheel. Complete rotations of the wheel are detected by a sensor mounted adjacent the wheels. The sensors are connected via wires to the feedback unit, which counts the rotations of wheel and displays the associated movement as a velocity over a given time period in miles/hour to a precision of ±0.1 miles/hr or as a total distance traveled in feet or miles. Of course, the units may be metric instead of English.

The mobility assistance apparatus or walker apparatus of this invention is a novel apparatus designed to provide balanced support for elderly individuals or other disabled populations needing walking assistance, while helping them maintain proper posture, gait mechanics, and gait velocity. Improvements in these parameters result in greater ground reaction forces, which are necessary mechanical stimuli for the protection of muscle and bone. Maintenance of muscle strength and gait velocity is associated with improved independence in instrumental activities of daily living (IADL) patients and activities of daily living (ADL) patients. This new apparatus uniquely provides the user with a means to maintain and even improve muscle function, bone density, and aerobic conditioning not otherwise provided (and in fact negatively impacted) by existing walker assistive technologies.

Referring now to FIG. 1A, an embodiment of a walker apparatus of this invention, generally 100, is shown to include a frame assembly 102, a locomotion assembly 140, an forearm support assembly 160, and a kinematic feedback assembly 180, where the apparatus provides mobility assistance, while permitting visualization of movement velocity, loaded and unloaded motion, and other information concerning a patient's use of the mobility assistance apparatus.

An embodiment of the frame assembly 102 includes a plurality of front vertical support members 104, a plurality of back vertical support members 106, a plurality of front horizontal support members 108, a plurality of right side horizontal members 110 and a plurality of left side horizontal members 112. The vertical members 104 and 106 are connected to horizontal the members 108, 110, and 112 by frame joints 114. Each vertical member 104 or 106 includes a bottom end 116 having a frame/locomotion connector 118. One right side horizontal member 110' and one left side horizontal member 112' include frame/forearm connectors 120.

An embodiment of the locomotion assembly 140 includes a plurality of front rolling members **142*a* and a plurality of back rolling member 142*b*. Each rolling members 142*a* or 142*b* includes a locomotion/frame connector 144 adapted to detachably or non-detachably engage the frame/locomotion connector 118 of the vertical members 104 and 106**.

All of the rolling members 142*a* and 142*b* can be omnidirectional. In certain embodiments, the front rolling members 142*a* are omnidirectional, while the back rolling members 142*b* are unidirectional. By omnidirectional, the inventors mean that the rolling members can go in any direction. Such omnidirectional rolling members can include wheels mounted on a freely rotating shaft, a ball mounted in a housing, or any other mounted rolling device that permit motion in any direction. By unidirectional rolling member, the inventors mean that the rolling members can move backwards and forwards in only one direction. Such unidirectional rolling members include wheels on fixed shafts or other rolling devices that permit motion backwards and forwards in only one direction. Embodiments with the back rolling members that are unidirectional rolling members are adapted to minimize lateral motion of the apparatus 100 providing more controlled movement and reducing uncontrolled movement from side to side.

An embodiment of the forearm support assembly 160 includes two forearm supports 162, two forearm cushions 164, two weight measuring apparatuses or load monitors 166, and two monitor/support connectors 168 adapted to engage, detachably or fixedly to the support/monitor connectors 120.

An embodiment of the kinematic feedback assembly 180 includes a feedback unit 182 and electrical wires 184 extending from the feedback unit 182 to the monitors 166.

Embodiments of the kinematic feedback assembly can include wireless communication hardware and software to permit feedback, audio and/or visual data, information, or signals to be sent and received from a remote site, such as a doctor's office, hospital, patient monitoring center or other type of medical assistance institution. Such data information or signal can be used for remote monitoring to patient progress, patient exercise and usage protocols, etc. or for providing instructions to the patient for proper use of the apparatus, for changing exercise protocols, etc.

Figure 1B:
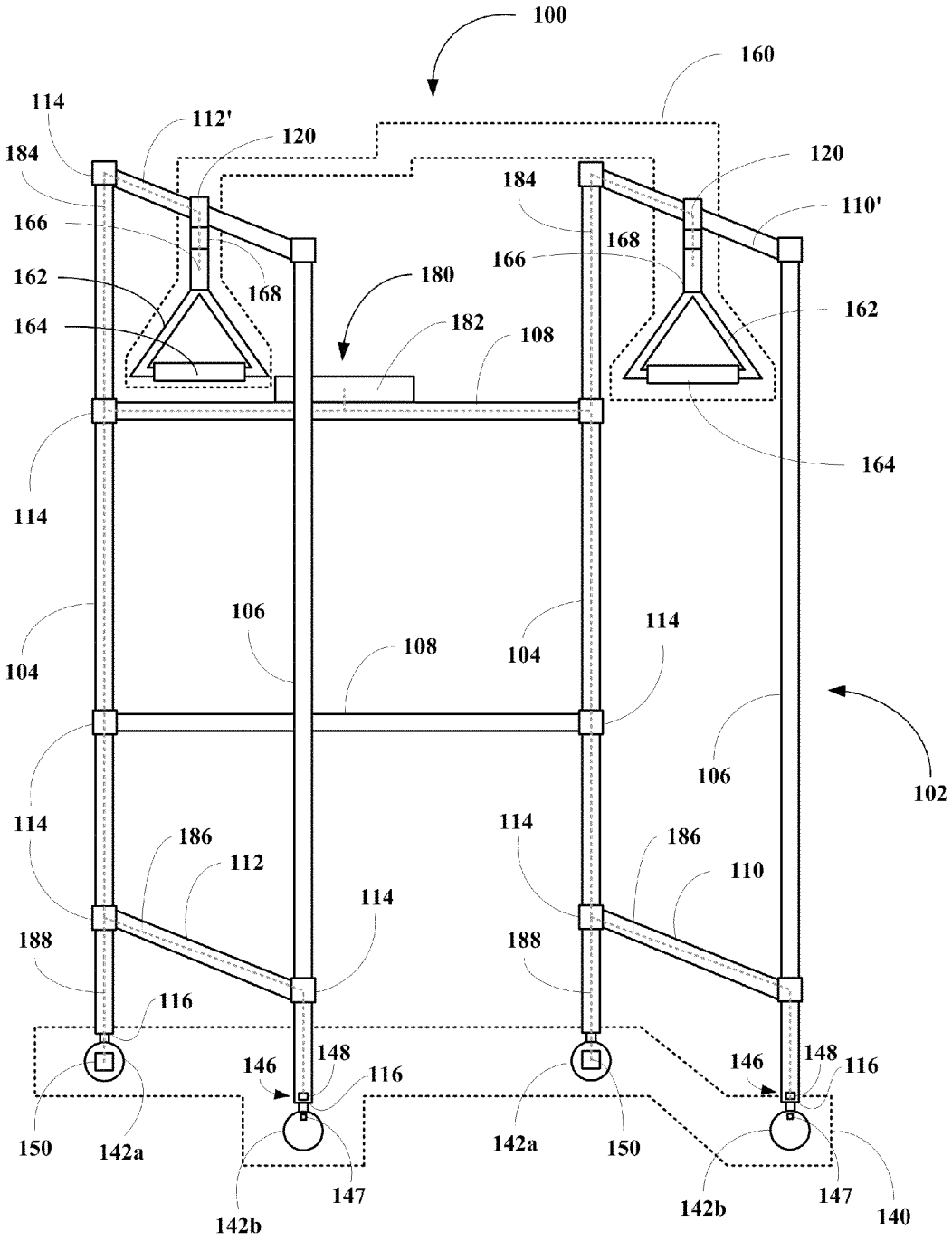
FIG. 1B depicts another embodiment of a mobility assistance apparatus of this invention.

Referring now to FIG. 1B, an embodiment of a walker apparatus of this invention, generally 100, is shown to include a frame assembly 102, a locomotion assembly 140, an forearm support assembly 160, and a kinematic feedback assembly 180, where the apparatus provides mobility assistance, while permitting visualization of movement velocity, loaded and unloaded motion, and other information concerning a patient's use of the mobility assistance apparatus.

An embodiment of the frame assembly 102 includes a plurality of front vertical support members 104, a plurality of back vertical support members 106, a plurality of front horizontal support members 108, a plurality of right side horizontal members 110 and a plurality of left side horizontal members 112. The vertical members 104 and 106 are connected to horizontal the members 108, 110, and 112 by frame joints 114. Each vertical member 104 or 106 includes a bottom end 116 having a frame/locomotion connector 118. One right side horizontal member 110' and one left side horizontal member 112' include frame/forearm connectors 120.

An embodiment of the locomotion assembly 140 includes a plurality of front rolling members 142*a* and a plurality of back rolling members 142*b*. Each rolling member 142*b* include velocity sensor 146, in this case comprising a magnet 147 affixed to each member 142*b* and a sensor 148. Although a specific velocity sensor has been disclosed, any other velocity sensor can be used as well. Optionally, each rolling member 142*a* includes an odometer 150 adapted to measure distance travels by measuring the number of rotations of the rolling members 142*a*.

An embodiment of the forearm support assembly 160 includes two forearm supports 162, two forearm cushions 164, two weight measuring apparatuses or load monitors 166, and two monitor/support connectors 168 adapted to engage, detachably or fixedly to the support/monitor connectors 120.

An embodiment of the kinematic feedback assembly 180 includes a feedback unit 182 and electrical wires 184 extending from the feedback unit 182 to the weight or load monitors 166. The feedback assembly 180 also includes electrical wires 186 extending from the feedback unit 182 to the velocity sensors 146. The feedback assembly 180 also includes electrical wires 188 extending from the feedback unit 182 to the odometers 150.

Figure 1C:
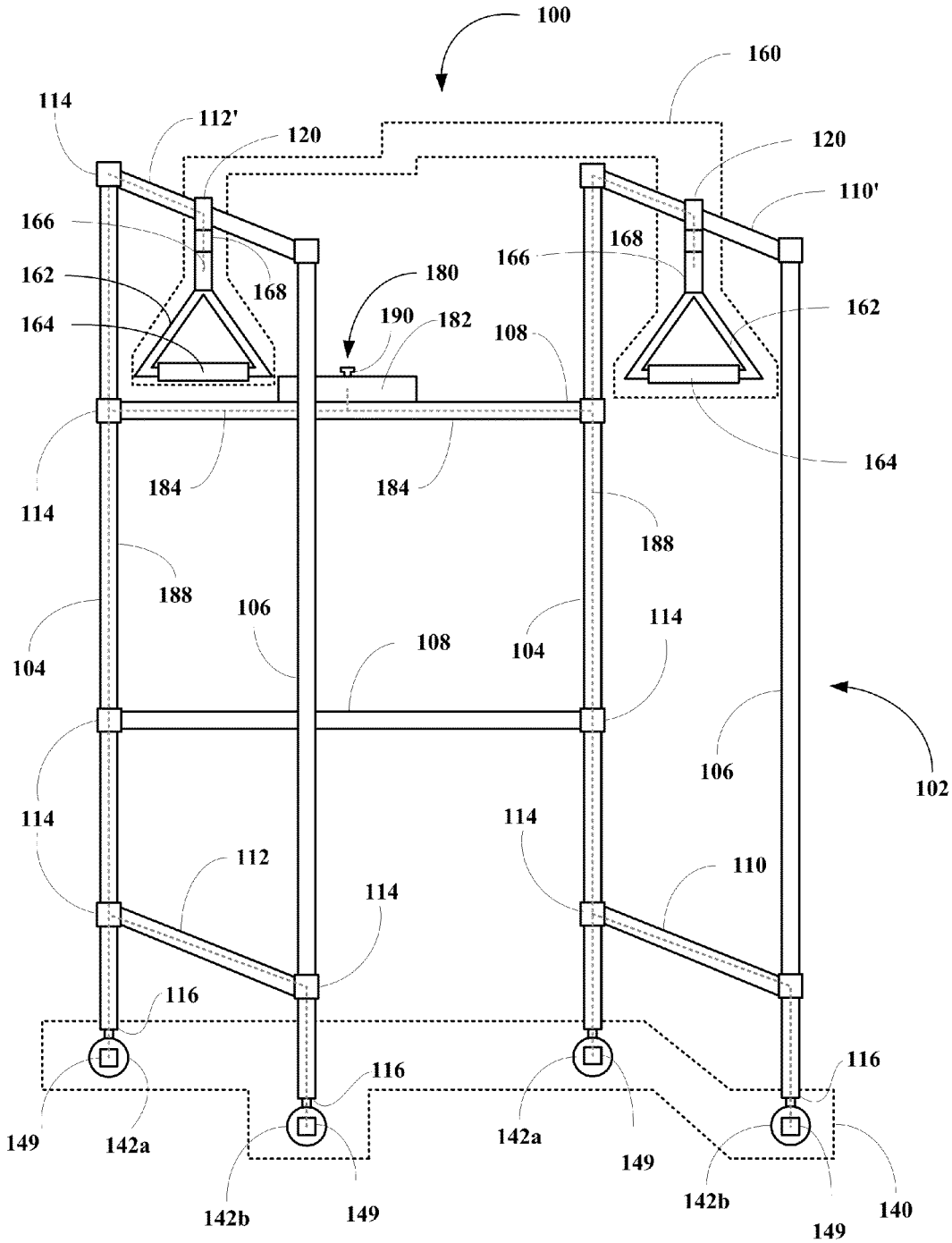
FIG. 1C depicts another embodiment of a mobility assistance apparatus of this invention.

Referring now to FIG. 1C, an embodiment of a walker apparatus of this invention, generally 100, is shown to include a frame assembly 102, a locomotion assembly 140, an forearm support assembly 160, and a kinematic feedback assembly 180, where the apparatus provides mobility assistance, while permitting visualization of movement velocity, loaded and unloaded motion, and other information concerning a patient's use of the mobility assistance apparatus.

An embodiment of the frame assembly 102 includes a plurality of front vertical support members 104, a plurality of back vertical support members 106, a plurality of front horizontal support members 108, a plurality of right side horizontal members 110 and a plurality of left side horizontal members 112. The vertical members 104 and 106 are connected to horizontal the members 108, 110, and 112 by frame joints 114. Each vertical member 104 or 106 includes a bottom end 116 having a frame/locomotion connector 118. One right side horizontal member 110' and one left side horizontal member 112' include frame/forearm connectors 120.

An embodiment of the locomotion assembly 140 includes a plurality of front rolling members 142*a* and a plurality of back rolling members 142*b*. Each rolling member 142*a* includes rolling member stops 149 adapted to arrest the ability for the rolling members to move bringing the apparatus to a stable stop.

An embodiment of the forearm support assembly 160 includes two forearm supports 162, two forearm cushions 164, two weight measuring apparatuses or monitors 166, and two monitor/support connectors 168 adapted to engage, detachably or fixedly to the support/monitor connectors 120.

An embodiment of the kinematic feedback assembly 180 includes a feedback unit 182 and electrical wires 184 extending from the feedback unit 182 to the monitors 166. The feedback assembly 180 also includes electrical wires 188 extending from the feedback unit 182 to the stops 149 and an emergency stop button 190.

Figure 1D:
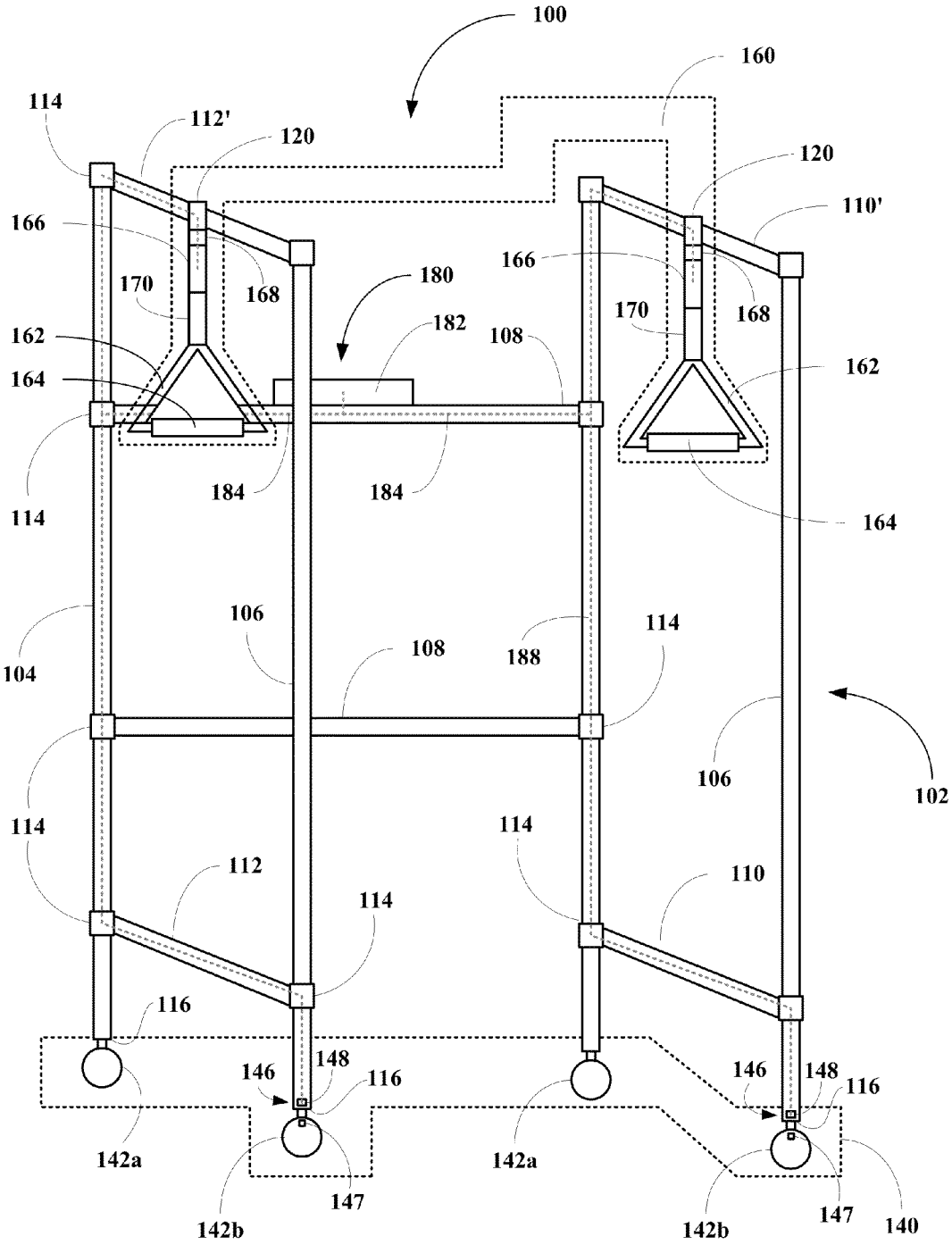
FIG. 1D depicts another embodiment of a mobility assistance apparatus of this invention.

Referring now to FIG. 1D, an embodiment of a walker apparatus of this invention, generally 100, is shown to include a frame assembly 102, a locomotion assembly 140, an forearm support assembly 160, and a kinematic feedback assembly 180, where the apparatus provides mobility assistance, while permitting visualization of movement velocity, loaded and unloaded motion, and other information concerning a patient's use of the mobility assistance apparatus.

An embodiment of the frame assembly 102 includes a plurality of front vertical support members 104, a plurality of back vertical support members 106, a plurality of front horizontal support members 108, a plurality of right side horizontal members 110 and a plurality of left side horizontal members 112. The vertical members 104 and 106 are connected to horizontal the members 108, 110, and 112 by frame joints 114. Each vertical member 104 or 106 includes a bottom end 116 having a frame/locomotion connector 118. One right side horizontal member 110' and one left side horizontal member 112' include frame/forearm connectors 120.

An embodiment of the locomotion assembly 140 includes a plurality of front rolling members 142*a* and a plurality of back rolling members 142*b*. Each rolling member 142*b* include velocity sensor 146, in this case comprising a magnet 147 affixed to each member 142*b* and a sensor 148. Although a specific velocity sensor has been disclosed, any other velocity sensor can be used as well.

An embodiment of the forearm support assembly 160 includes two forearm supports 162, two forearm cushions 164, two weight measuring apparatuses or monitors 166, two monitor/support connectors 168 adapted to engage, detachably or fixedly to the support/monitor connectors 120 and two adjustable fittings 170 adapted to permit the height of the forearm supports 162 to be adjusted.

An embodiment of the kinematic feedback assembly 180 includes a feedback unit 182 and electrical wires 184 extending from the feedback unit 182 to the monitors 166. The feedback assembly 180 also includes electrical wires 188 extending from the feedback unit 182 to the odometers 150.

Figure 1E:
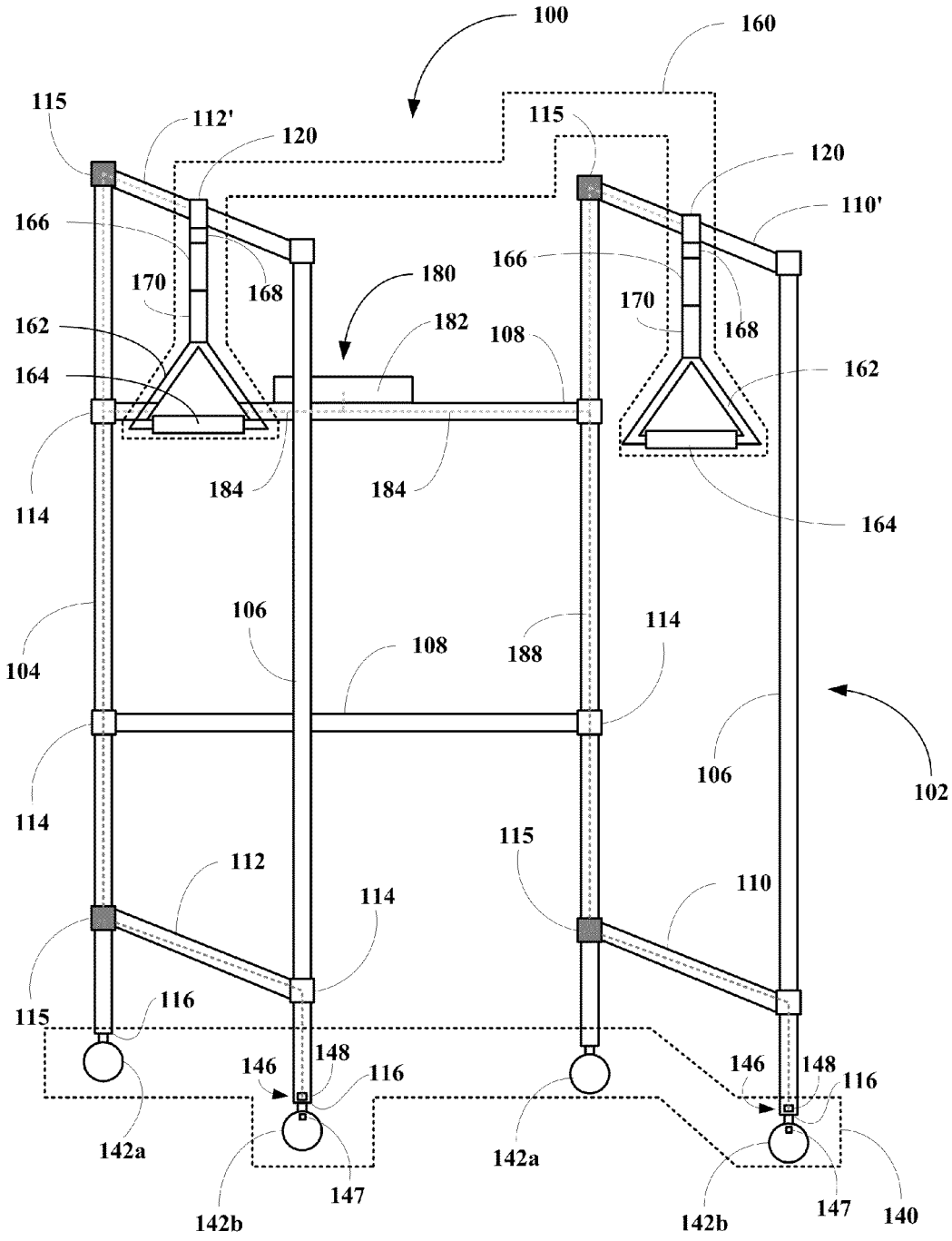
FIG. 1E depicts another embodiment of a mobility assistance apparatus of this invention.

Referring now to FIG. 1E, an embodiment of a walker apparatus of this invention, generally 100, is shown to include a frame assembly 102, a locomotion assembly 140, an forearm support assembly 160, and a kinematic feedback assembly 180, where the apparatus provides mobility assistance, while permitting visualization of movement velocity, loaded and unloaded motion, and other information concerning a patient's use of the mobility assistance apparatus.

An embodiment of the frame assembly 102 includes a plurality of front vertical support members 104, a plurality of back vertical support members 106, a plurality of front horizontal support members 108, a plurality of right side horizontal members 110 and a plurality of left side horizontal members 112. The vertical members 104 and 106 are connected to horizontal the members 108, 110, and 112 by frame joints 114 and swivel joints 115 adapted to permit the right side and left side horizontal members 110 and 112 to fold toward the front horizontal members 108 so that the apparatus 100 can be collapsed. The swivel joints 115 of course lock in place in either the collapsed or uncollapsed state. Each vertical member 104 or 106 includes a bottom end 116 having a frame/locomotion connector 118. One right side horizontal member 110' and one left side horizontal member 112' include frame/forearm connectors 120.

An embodiment of the locomotion assembly 140 includes a plurality of front rolling members 142*a* and a plurality of back rolling members 142*b*. Each rolling member 142*b* include velocity sensor 146, in this case comprising a magnet 147 affixed to each member 142*b* and a sensor 148. Although a specific velocity sensor has been disclosed, any other velocity sensor can be used as well.

An embodiment of the forearm support assembly 160 includes two forearm supports 162, two forearm cushions 164, two weight measuring apparatuses or monitors 166, two monitor/support connectors 168 adapted to engage, detachably or fixedly to the support/monitor connectors 120 and two adjustable fittings 170 adapted to permit the height of the forearm supports 162 to be adjusted.

An embodiment of the kinematic feedback assembly 180 includes a feedback unit 182 and electrical wires 184 extending from the feedback unit 182 to the monitors 166. The feedback assembly 180 also includes electrical wires 186 extending from the feedback unit 182 to the odometers 150.

Figure 1F:
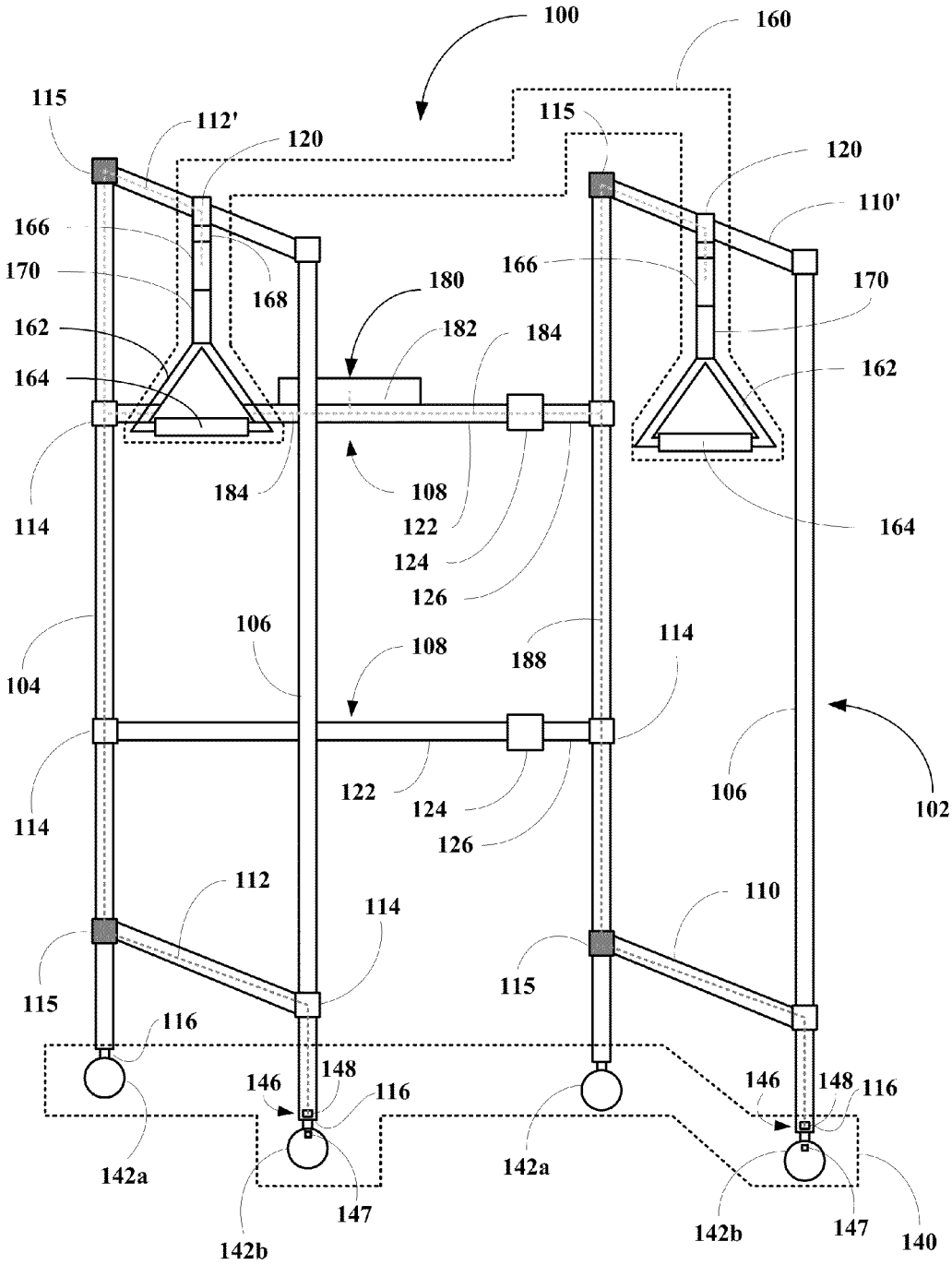
FIG. 1F depicts another embodiment of a mobility assistance apparatus of this invention.

Referring now to FIG. 1F, an embodiment of a walker apparatus of this invention, generally 100, is shown to include a frame assembly 102, a locomotion assembly 140, an forearm support assembly 160, and a kinematic feedback assembly 180, where the apparatus provides mobility assistance, while permitting visualization of movement velocity, loaded and unloaded motion, and other information concerning a patient's use of the mobility assistance apparatus.

An embodiment of the frame assembly 102 includes a plurality of front vertical support members 104, a plurality of back vertical support members 106, a plurality of front horizontal support member assemblies 108, a plurality of right side horizontal members 110 and a plurality of left side horizontal members 112. The vertical members 104 and 106 are connected to horizontal the members 108, 110, and 112 by frame joints 114 and swivel joints 115 adapted to permit the right side and left side horizontal members 110 and 112 to fold toward the front horizontal members 108 so that the apparatus 100 can be collapsed. The swivel joints 115 of course lock in place in either the collapsed or uncollapsed state. Each vertical member 104 or 106 includes a bottom end 116 having a frame/locomotion connector 118. One right side horizontal member 110' and one left side horizontal member 112' include frame/forearm connectors 120. Each front horizontal support member assembly 108 includes a fixed member 122, a locking fitting 124 and a slidable member 126, where the slidable member 126 is adapted to slide into and out of the fixed member so that a length L of the assemblies 108 can be adjusted. The locking fittings 124 are adapted to permit adjustment of the slidable member 126 and lock the slidable member 126 into place when a desired length L is achieved.

An embodiment of the locomotion assembly 140 includes a plurality of front rolling members 142*a* and a plurality of back rolling members 142*b*. Each rolling member 142*b* include velocity sensor 146, in this case comprising a magnet 147 affixed to each member 142*b* and a sensor 148. Although a specific velocity sensor has been disclosed, any other velocity sensor can be used as well.

An embodiment of the forearm support assembly 160 includes two forearm supports 162, two forearm cushions 164, two weight measuring apparatuses or monitors 166, and two monitor/support connectors 168 adapted to engage, detachably or fixedly to the support/monitor connectors 120.

An embodiment of the kinematic feedback assembly 180 includes a feedback unit 182 and electrical wires 184 extending from the feedback unit 182 to the monitors 166. The feedback assembly 180 also includes electrical wires 188 extending from the feedback unit 182 to the odometers 150.

It should be recognized that the apparatus 100 can include any or all of the specific features described in FIG. 1A-F and the apparatus 100 is not limited to any specific design, but these design features are included so that the apparatus 100 has sufficient design flexibility to meet the needs of the patient.

Specific Embodiments of Forearm Supports

Figure 2A:
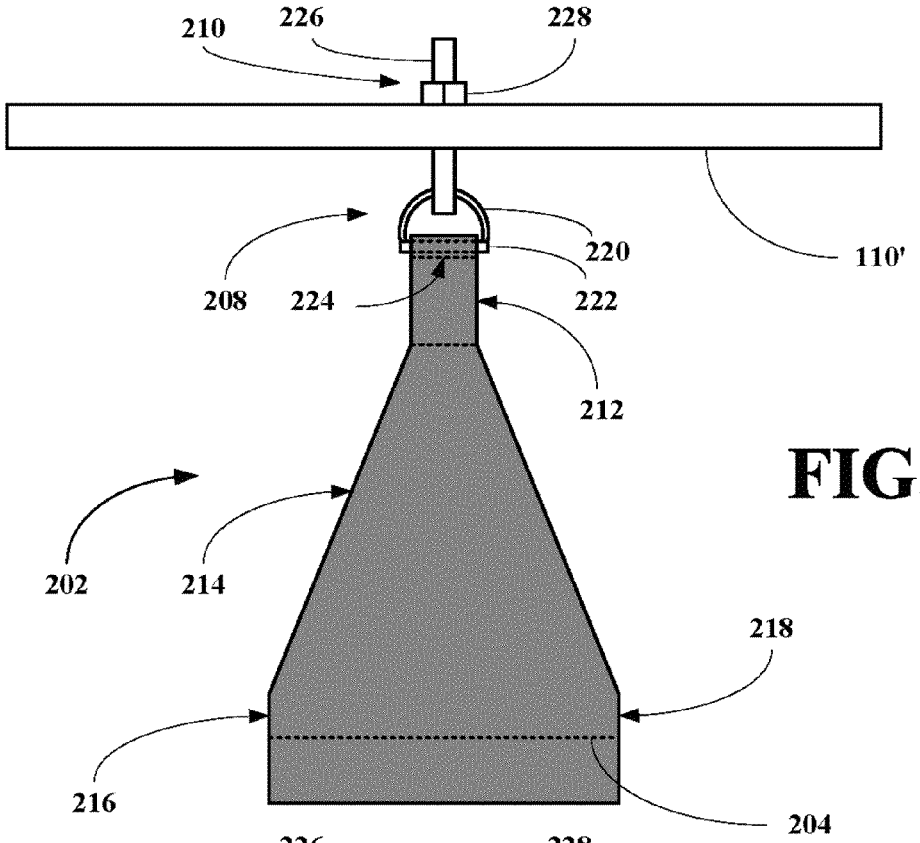
FIG. 2A depicts an embodiment of the forearm support assembly of this invention.

Referring now to FIG. 2A, an embodiment of the forearm support assembly 200 is shown to include a forearm support 202, a forearm cushion 204, a connector 208, and a mount 210 adapted to detachably or fixedly connect to the connector 208 to the mounted on the support member 110'. The support 202 is shown to be of a symmetrically disposed hexagonal shape having a closed upper section 212 (single piece or two pieces stitched together), an opened middle section 214 and an opened lower section 216. The cushion 204 is disposed in an interior 218 of the support 202 at its lower section 216. The connector 208 includes a U-shaped member 220 and a straight member 222. The U-shaped member 220 is adapted to engage the mount 210, while the straight member 222 is adapted to engage the upper section 212 of the support 202, which include an aperture 224 through which the straight member 222 extends. The mount 210 is shown here to be a threaded post 226 and a securing nut 228. The middle and lower sections 214 and 216 are opened so that a patient's forearm can be inserted therethrough.

Figure 2B:
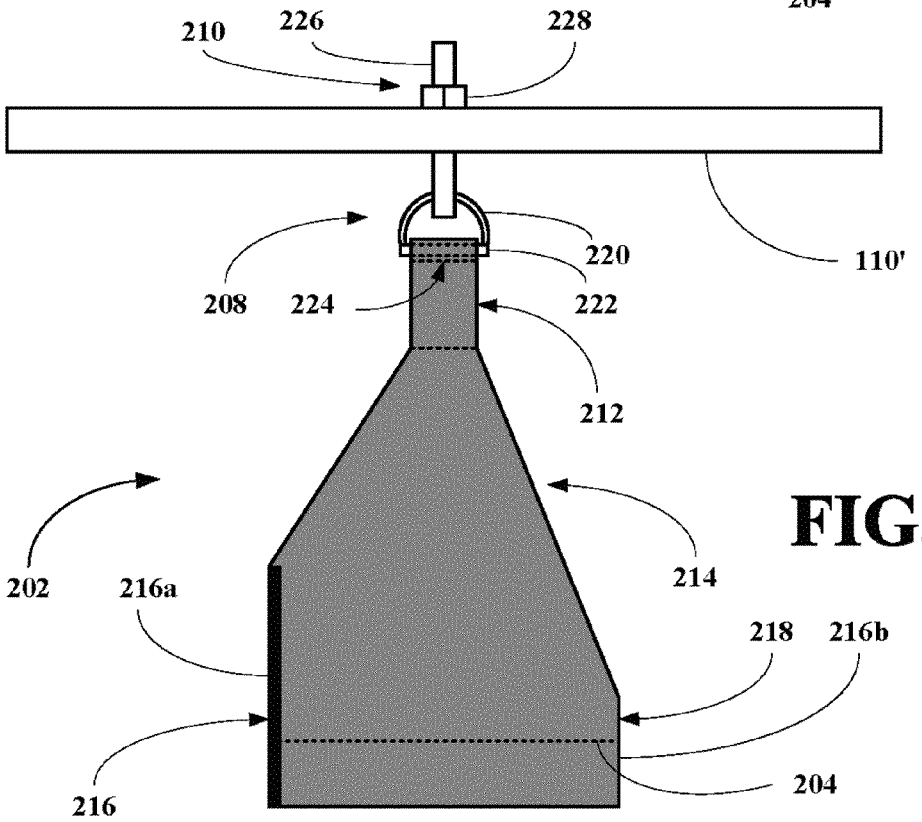
FIG. 2B depicts another embodiment of the forearm support assembly of this invention.

Referring now to FIG. 2B, another embodiment of the forearm support assembly 200 is shown to include a forearm support 202, a forearm cushion 204, a connector 208, and a mount 210 adapted to detachably or fixedly connect to the connector 208 to the mounted on the support member 110'. The support 202 is shown to be of an asymmetrically disposed hexagonal shape having a closed upper section 212 (single piece or two pieces stitched together), an asymmetrical, opened middle section 214 and a lower section 216 having a closed elbow restraint end 216*a* and an open end 216*b*. The cushion 204 is disposed in an interior 218 of the lower section 216. The connector 208 includes a U-shaped member 220 and a straight member 222. The U-shaped member 220 is adapted to engage the mount 210, while the straight member 214 is adapted to engage the upper section of the support, which includes an aperture 224 through which the straight member 222 extends. The mount 210 is shown here to be a threaded post 226 and a securing nut 228. The middle section 214 is opened so that a patient's forearm can be inserted therethrough.

Figure 2C:
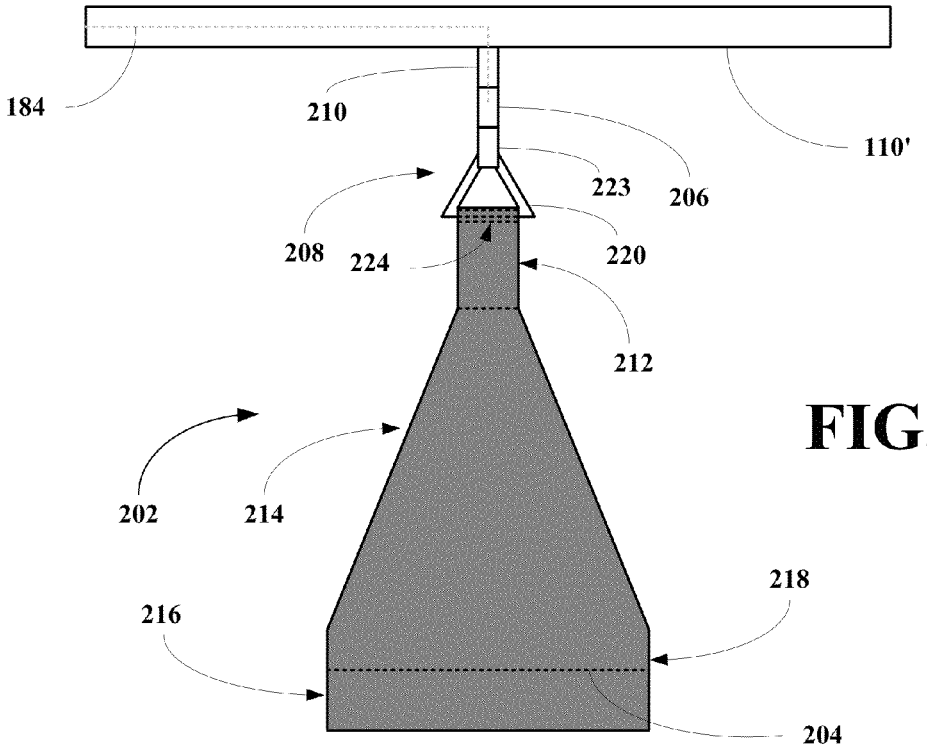
FIG. 2C depicts another embodiment of the forearm support assembly of this invention.

Referring now to FIG. 2C, another embodiment of the forearm support assembly 200 is shown to include a forearm support 202, a forearm cushion 204, a weight measuring sensor or monitor 206 including a connector 208 adapted to detachably or fixedly connect the monitor 206 to the support 202, and a mount 210 adapted to detachably or fixedly connect to the connector 208 to mount the monitor 206 to the support member 110'. The support 202 is shown to be of a symmetrically disposed hexagonal shape having a closed upper section 212, an opened middle section 214 and an opened lower section 216. The cushion 204 is disposed in an interior 218 of the lower section 216. The connector 208 includes a triangular member 220 and a straight member 223. The straight member 223 is adapted to engage the mount 210, while the triangular member 220 is adapted to engage the upper section of the support, which includes an aperture 224 through which the triangular member 220 extends. The mount 210 is shown extended from the member 110', which can be integral with or detachably connected to the member 110'. The middle and lower sections 214 and 216 are opened so that a patient's forearm can be inserted therethrough.

Figure 2D:
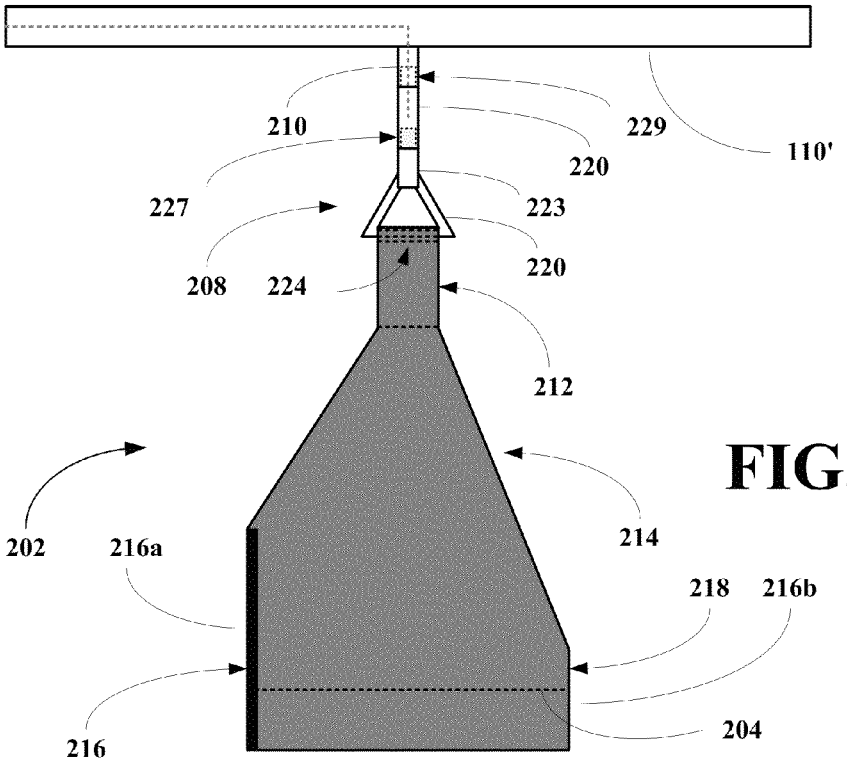
FIG. 2D depicts another embodiment of the forearm support assembly of this invention.

Referring now to FIG. 2D, another embodiment of the forearm support assembly 200 is shown to include a forearm support 202, a forearm cushion 204, a weight measuring sensor or monitor 206 including a connector 208 adapted to detachably or fixedly connect the monitor 206 to the support 202, and a mount 210 adapted to detachably or fixedly connect to the connector 208 to mount the monitor 206 to the support member 110'. The support 202 is shown to be of an asymmetrically disposed hexagonal shape having a closed upper section 212 (single piece or two pieces stitched together), an asymmetrical, opened middle section 214 and a lower section 216 having a closed elbow restraint end 216*a* and an open end 216*b*. The cushion 204 is disposed in an interior 218 of the lower section 216. The connector 208 includes a triangular member 220 and a straight member 223. The straight member 223 is adapted to detachably engage the sensor 206 via a connection 227, while the triangular member 220 is adapted to engage the upper section 212 of the support 202, which includes an aperture 224 through which the triangular member 220 extends. The sensor 206 is adapted to detachably engage the mount 210 via a connection 229. The mount 210 is shown extended from the member 110', which can be integral with or detachably connected to the member 110'. The middle and lower sections 214 and 216 are opened so that a patient's forearm can be inserted therethrough.

Figure 2E:
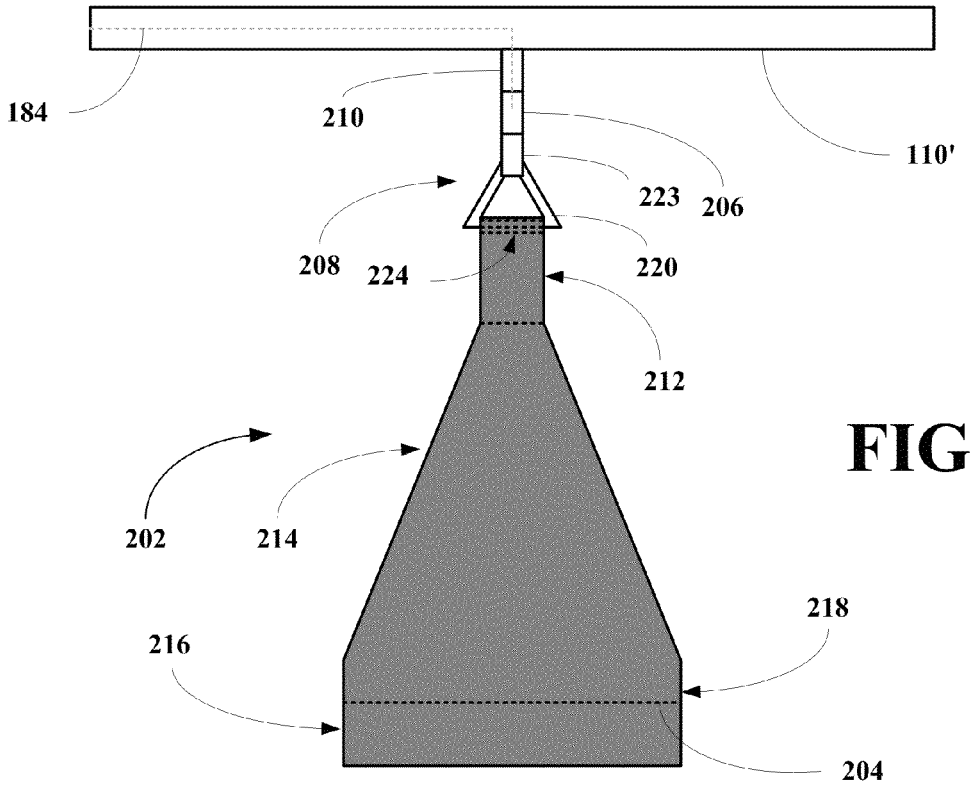
FIG. 2E depicts another embodiment of the forearm support assembly of this invention.
Figure 2F:
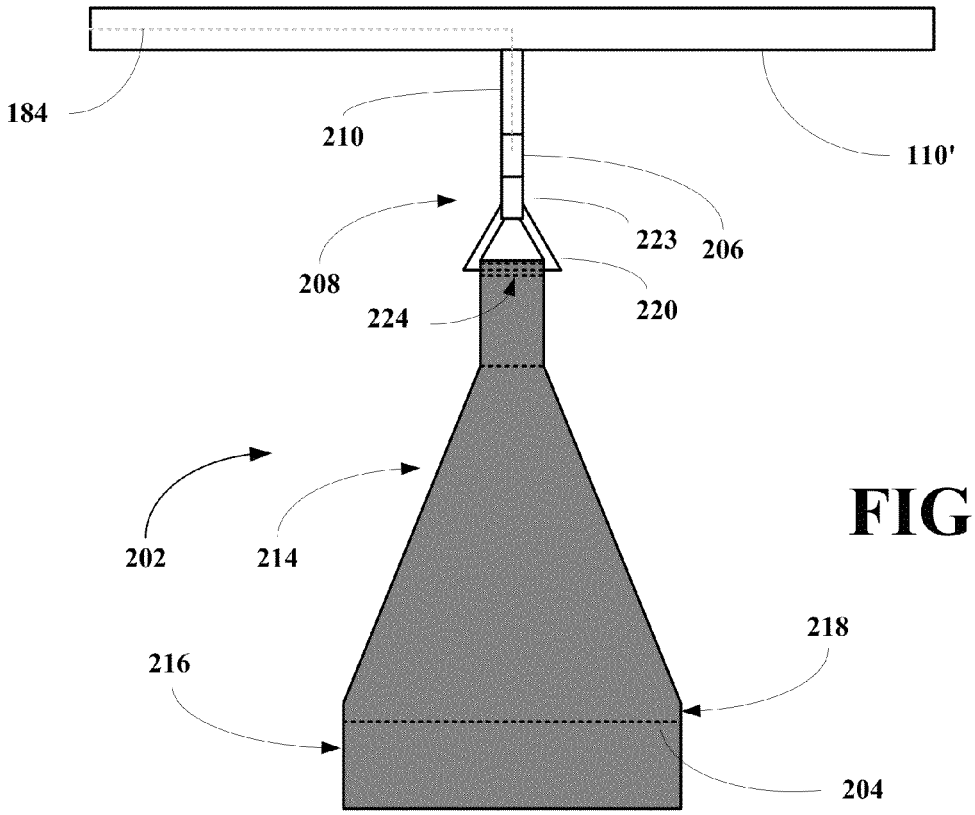
FIG. 2F depicts another embodiment of the forearm support assembly of this invention.

Referring now to FIGS. 2E&F, another embodiment of the forearm support assembly 200 is shown to include a forearm support 202, a forearm cushion 204, a weight measuring sensor or monitor 206 including a connector 208 adapted to detachably or fixedly connect the monitor 206 to the support 202, and an adjustable mount 210 adapted to detachably or fixedly connect to the connector 208 and to mount the monitor 206 to the support member 110'. FIG. 2E shows the adjustable mount 210 in its collapsed state, while FIG. 2E shows the adjustable mount 210 in its extended state. The support 202 is shown to be of a symmetrically disposed hexagonal shape having a closed upper section 212, an opened middle section 214 and an opened lower section 216. The cushion 204 is disposed in an interior 218 of the lower section 216. The connector 208 includes a triangular member 220 and a straight member 223. The straight member 223 is adapted to engage the mount 210, while the triangular member 220 is adapted to engage the upper section of the support, which includes an aperture 224 through which the triangular member 220 extends. The mount 210 is shown extended from the member 110', which can be integral with or detachably connected to the member 110'. The middle and lower sections 214 and 216 are opened so that a patient's forearm can be inserted therethrough.

Feedback Units

Figure 3A:
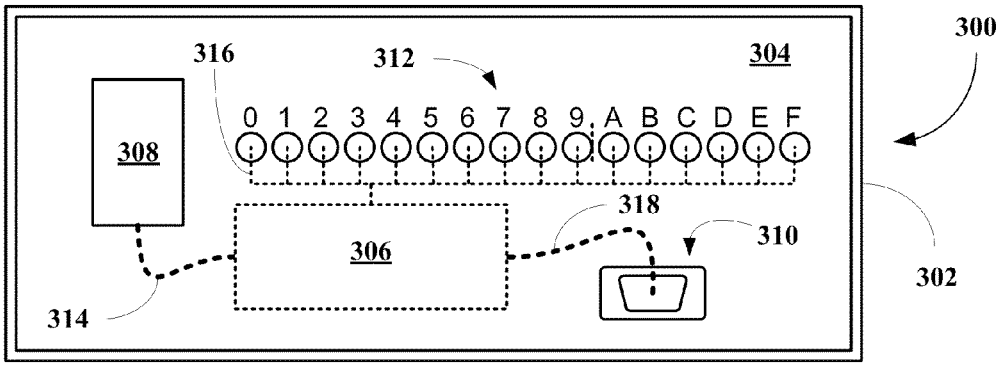
FIG. 3A depicts an embodiment of the feedback assembly of this invention.

Referring now to FIG. 3A, an embodiment of the kinematic and a kinetic feedback assembly, generally 300, is shown to include a platform 302 and a feedback unit 304. The feedback unit 304 includes a processing unit 306 having memory, an operating system, and communications hardware and software. The feedback unit 304 also includes a display 308, a cable connector 310 and a plurality of labeled indicator lights 312, here the plurality is sixteen and the labels run from O-F, but in other embodiments, the plurality may be from 2 to about 20. The cable connector 310 is adapted to receive a cable connecting the processing unit 306 via wires to the weight monitors, optional movement sensors and optionally other sensors. The display 308 is connected to the processing unit 306 via a display cable 314; the lights 312 are connected to the processing unit 306 via light cables 316; and the cable connector 310 is connected to the processing unit 306 via a cable connector cable 318. The lights 312 may be adapted to indicate walking velocity, walking distance or other walking properties. All of the cables may support unidirectional or bidirectional electronic communication.

Figure 3B:
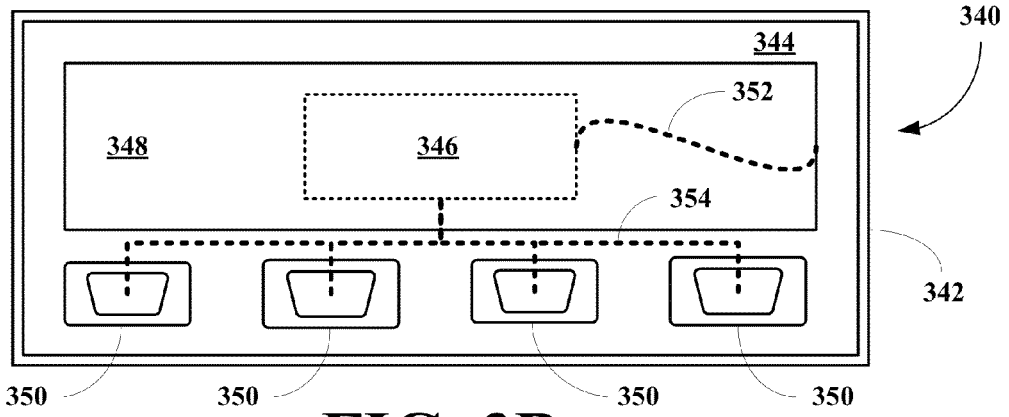
FIG. 3B depicts another embodiment of the feedback assembly of this invention.

Referring now to FIG. 3B, another embodiment of the kinematic and a kinetic feedback assembly, generally 340, is shown to include a platform 342 and a feedback unit 344. The feedback unit 344 includes a processing unit 346 having memory, an operating system, and communications hardware and software. The feedback unit 344 also includes a display 348 and four cable connectors 350. The cable connectors 350 are adapted to receive a cable connecting the processing unit 346 via wires to the weight monitors, optional movement sensors and optionally other sensors. The display 348 is connected to the processing unit 346 via a display cable 352 and the cable connector 350 is connected to the processing unit 346 via cable connector cable 354. All of the cables may support unidirectional or bidirectional electronic communication.

Figure 3C:
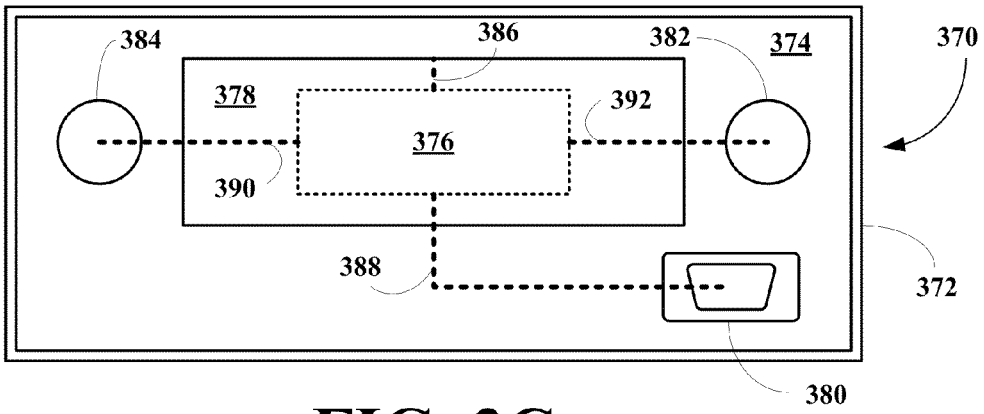
FIG. 3C depicts another embodiment of the feedback assembly of this invention.

Referring now to FIG. 3C, another embodiment of the kinematic and a kinetic feedback assembly, generally 370, is shown to include a platform 372 and a feedback unit 374. The feedback unit 374 includes a processing unit 376 having memory, an operating system, and communications hardware and software. The feedback unit 374 also includes a display 378 and a cable connector 380. The cable connector 380 is adapted to receive a cable connecting the processing unit 376 via wires to the weight monitors, optional movement sensors and optionally other sensors. The feedback unit 374 also includes a speaker 382 and a microphone 384. The display 378 is connected to the processing unit 376 via a display cable 386; the connector 380 is connected to the processing unit 376 via a cable connector cable 388; the speaker 382 is connected to the processing unit 376 via a speaker cable 392 and the microphone 384 is connected to the processing unit 376 via a microphone cable 390. All of the cables may support unidirectional or bidirectional electronic communication.

Figure 3D:
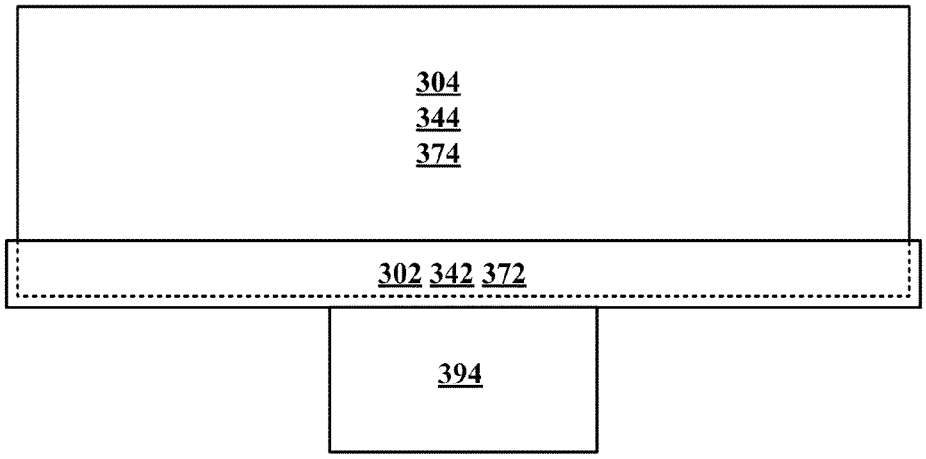
FIG. 3D depicts an embodiment of the platform and platform/frame of this invention.

Referring now to FIG. 3D, an embodiment of the platform 302, 342 or 372 is shown to include a platform/frame connector 394. The connector 394 may be a clip on connector, a C-shaped member with a thumb screw, or any other connector designed to connect the platform to a horizontal member of the frame.

Figure 3E:
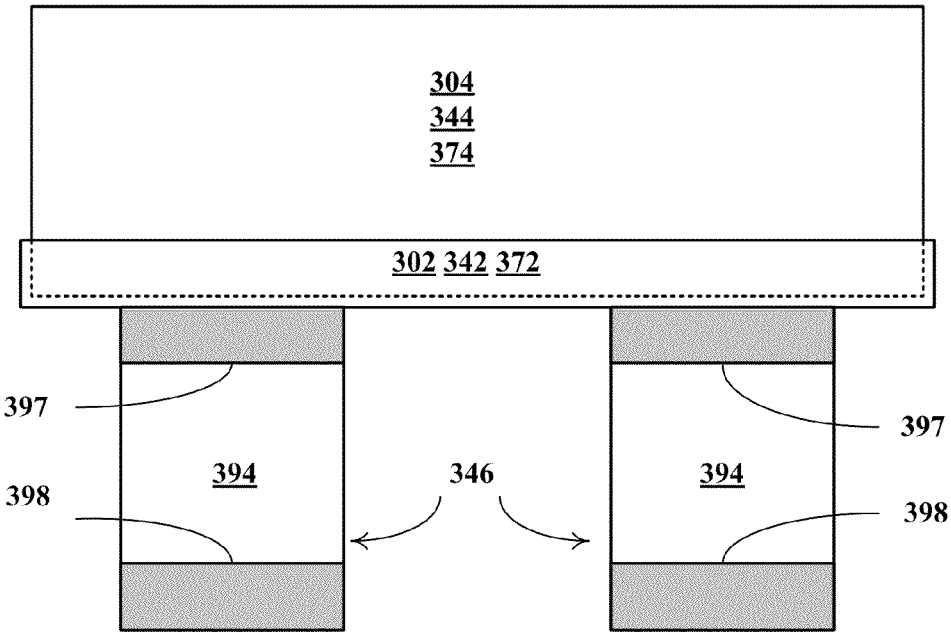
FIG. 3E depicts another embodiment of the platform and platform/frame of this invention.

Referring now to FIG. 3E, another embodiment of the platform 302, 342 or 372 is shown to include a platform/frame connector 394. The connector 394 comprises at least one strap 396 to surround a horizontal member of the frame to secure the platform and the feedback unit to the horizontal member. Here, two straps 396 are shown, which comprise a hook type connector 397 and a loop type connector 398.

Figure 3F:
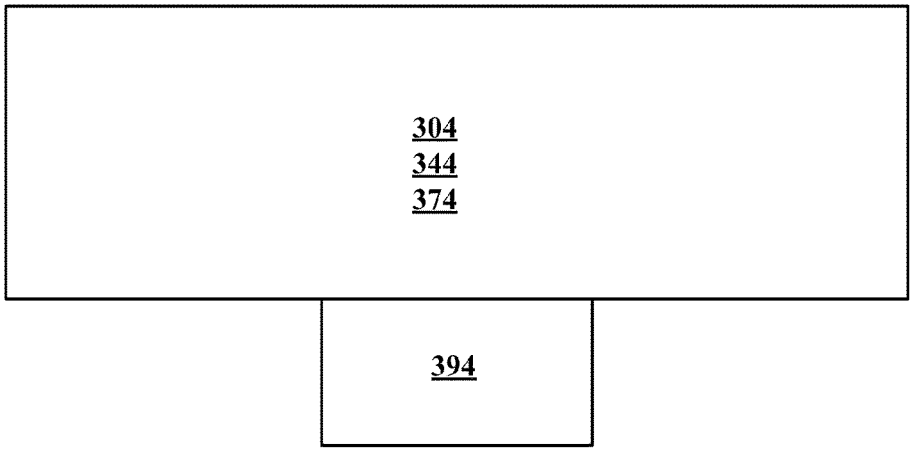
FIG. 3F depicts another embodiment of the platform and platform/frame of this invention.

Referring now to FIG. 3F, the feedback units 304, 344 and 374 are shown without a platform 302, 342 or 372 with the frame connector 394 attached directly to the units 304, 344 and 374.

The connector 394 may be a clip on connector, a C-shaped member with a thumb screw, or any other connector designed to connect the platform to a horizontal member of the frame.

Figure 3G:
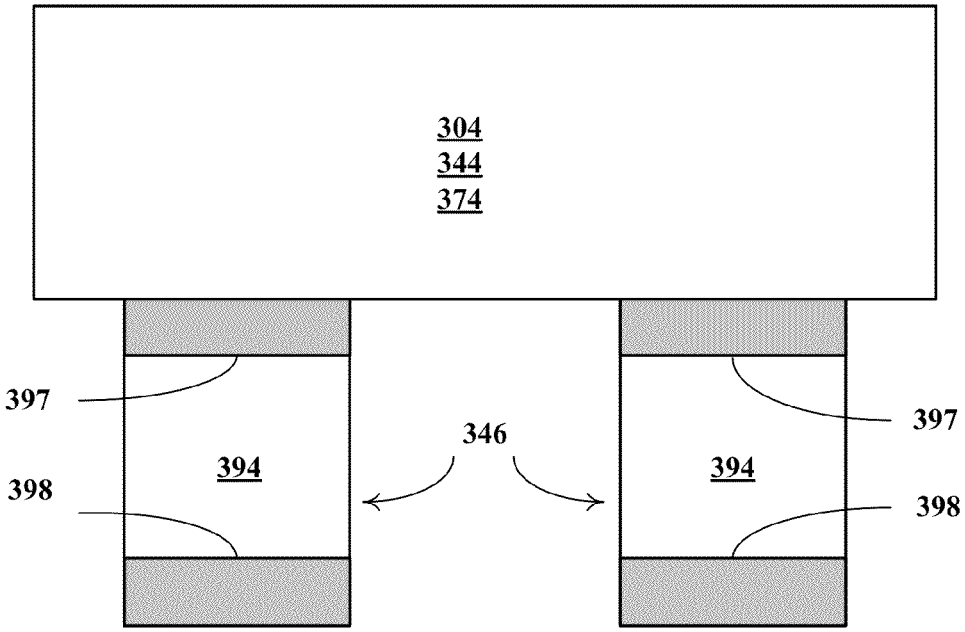
FIG. 3G depicts another embodiment of the platform and platform/frame of this invention.

Referring now to FIG. 3G, the feedback units 304, 344 and 374 are shown without a platform 302, 342 or 372 with the connector 394. The connector 394 comprises at least one strap 396 to surround a horizontal member of the frame to secure the platform and the feedback unit to the horizontal member. Here, two straps 396 are shown, which comprise a hook type connector 397 and a loop type connector 398.

Figure 4A:
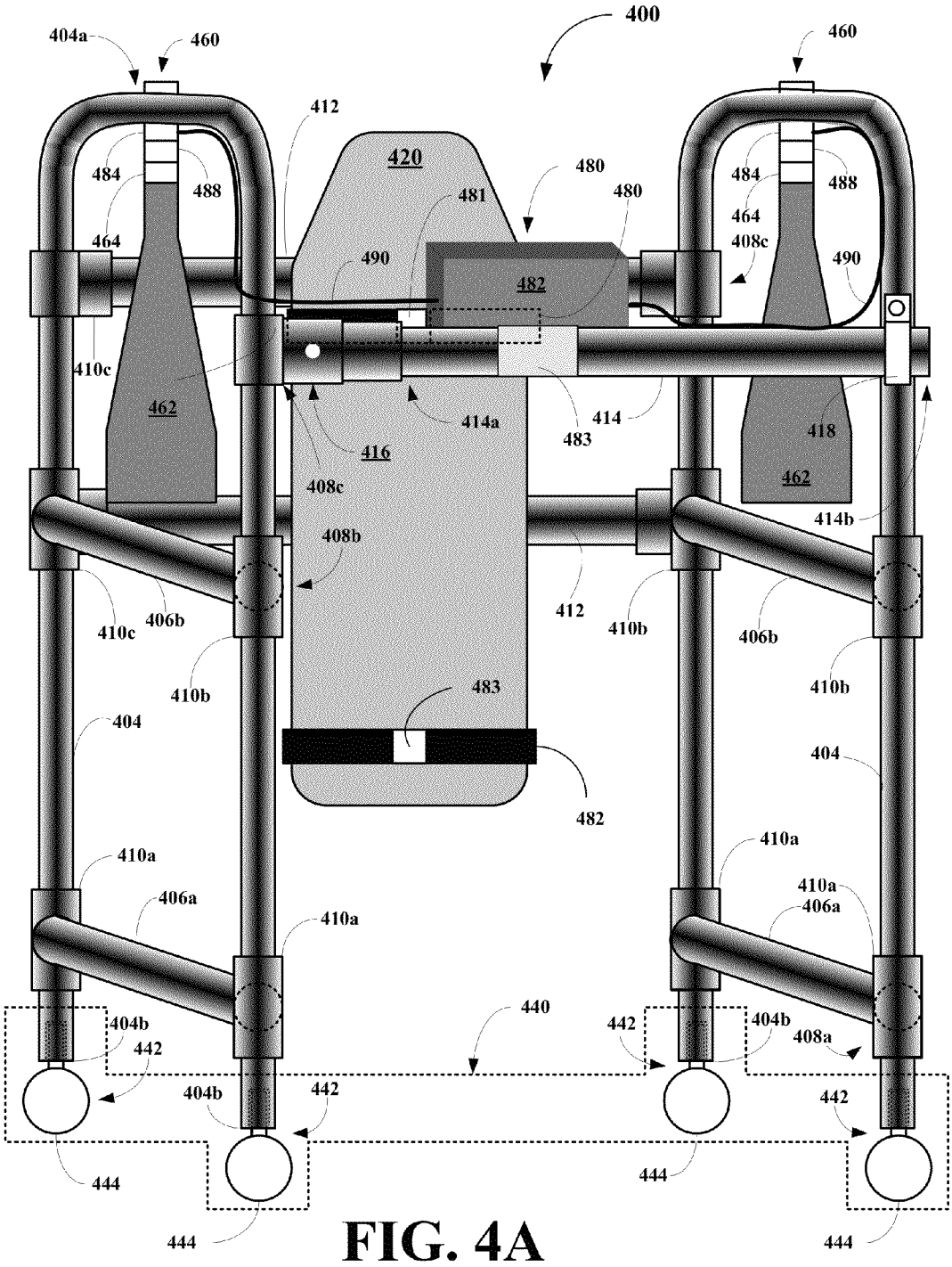
FIG. 4A depicts an embodiment of a mobility assistance apparatus of this invention.
Figure 4B:
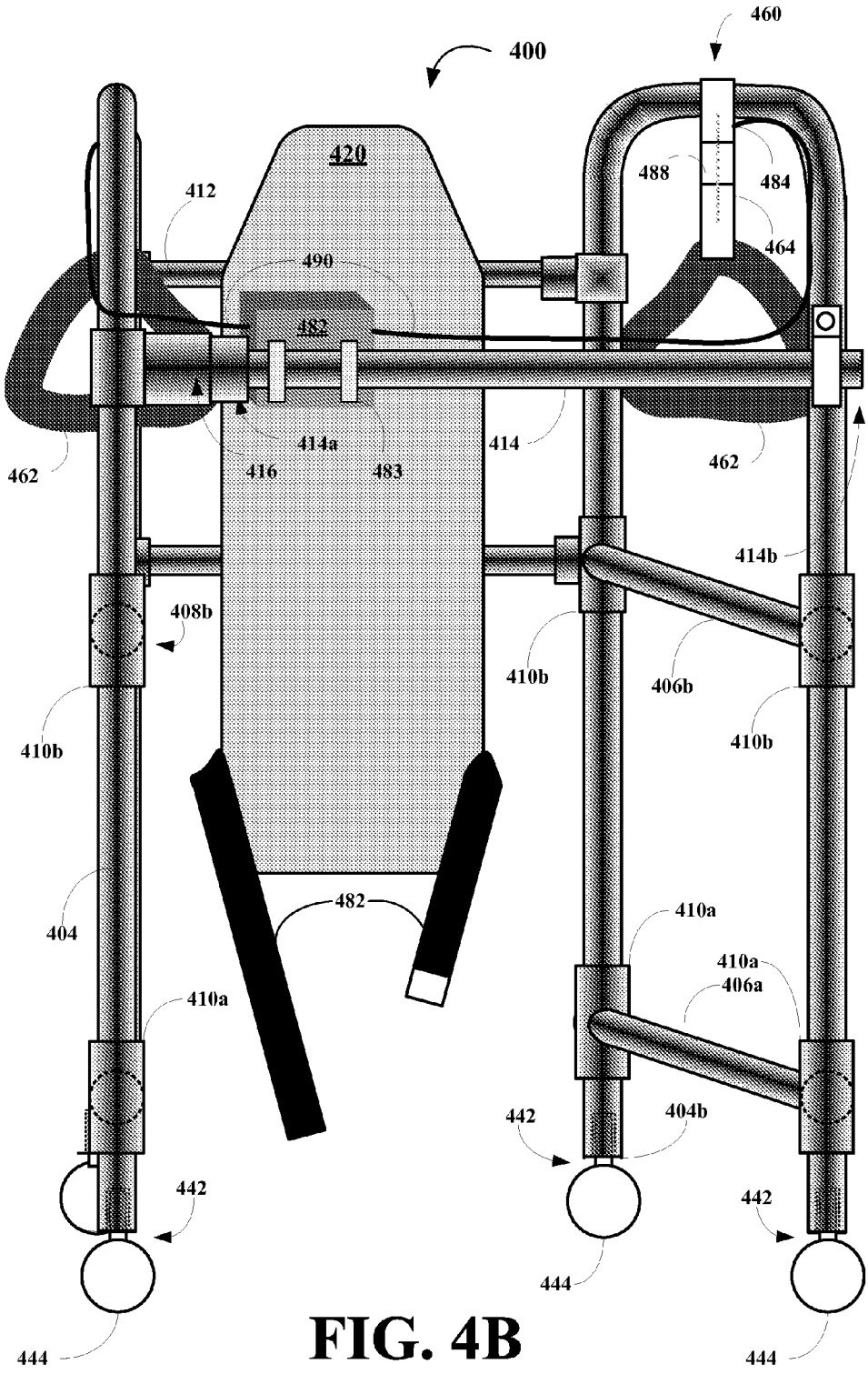
FIG. 4B depicts an edited photograph (remove the background) of the apparatus of FIG. 4A.

Referring now to FIG. 4A, another embodiment of a walker apparatus of this invention, generally 400, is shown to include a frame assembly 402, a locomotion assembly 440, an forearm support assemblies 460, and a kinematic feedback assembly 480, where the apparatus provides mobility assistance, while permitting visualization of movement velocity, loaded and unloaded motion, and other information concerning a patient's use of the mobility assistance apparatus. The apparatus 400 is shown in an edited photograph in FIG. 4B.

The frame assembly 402 includes two U-shaped side members 404 having their U-turn section 404*a* situated up and their ends 404*b* situated down. The frame assembly 402 also includes four brace members 406 for bracing the U-shaped side members 404. Two of the brace members 406*a* are disposed on a lower location 408*a* along a height h of the U-shaped side members 404 and the other two brace members 406*b* are disposed at a middle location 408*b* along the height h. The lower brace members 406*a* are held in place by lower single socket joints 410*a*. The upper brace members 406*b* are held in place by middle single socket joints 410*b* and middle dual joints 410*c*, where the dual joints 410*c* include perpendicular disposed member sockets. The frame assembly 402 also includes two horizontal back members 412 connecting the two U-shaped side members 404. One of the members 412 is disposed at the middle location 408*b* and extends between and is held in place by the upper dual joints 410*c*. The second of the members 412 is disposed at an upper location 408*c* and is held in place by two upper single socket joints 410*c*. The frame assembly 402 also includes a front horizontal member 414, a pivoting joint 416 situated at the upper location 408*c* and an end receiving fitting 418. The front horizontal member 414 is mounted at its first end 414*a* on the pivoting joint 416, while the fitting 418 is adapted to receive its second end 414*b*, when the member 414 is in its closed position. The member 414 is adapted to swing up to permit ingress and egress from the frame assembly 402. In this way, the frame assembly forms a structure surrounding the user. The frame assembly 402 also includes a back support member 420. The back support member 420 may include a cervical support strap 480 having an adjustable connection 481 and a lumbar support strap 482 having an adjustable connection 483, where the straps 480 and 482 are adapted to support the user so that the user's back is held against the back support member 420 and are adapted to insure that the user has proper posture when using the apparatus.

The locomotion assembly 440 include four locomotion units 442 including wheels 444 mounted on the ends 404*b* of the U-shaped members 404. All four locomotion units 442 are capable of direction in any direction permitting the apparatus 400 full range of motion.

Each forearm support assembly 460 includes a flexible forearm support member 462 for receiving and supporting a user's forearm. The forearm support assembly 460 also includes a member/monitor connector 464 for hanging the members 462 from weight monitors as described below.

The kinematic feedback assembly 480 includes a feedback unit 482 mounted to the member 414 by a connector 483 and two weight monitors 484 mounted in the U-turns 404*a* of the members 404 by mounts 486 (not shown). The monitors 484 include a monitor/member connector 488, where the monitor/member connector 488 is adapted to engage the member/monitor connector 464 so that the forearm support member 462 hangs from the weight monitor 484 so that off-loaded weight may be measured and monitored by the feedback unit 482. The feedback assembly 480 also includes wires 490 connecting the weight monitors 484 to the feedback unit 482.

Back Support Assembly

Figure 5A:
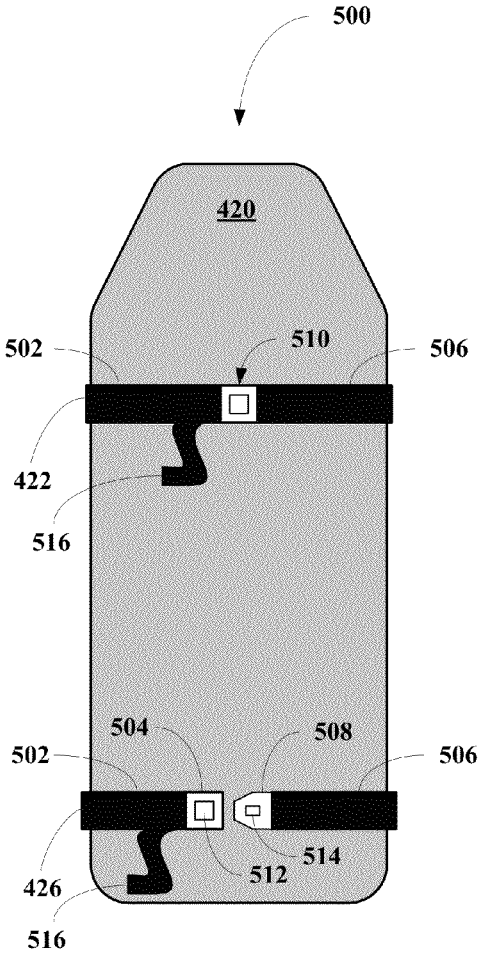
FIGS. 5A and B depict an embodiment of a back support of this invention.
Figure 5B:
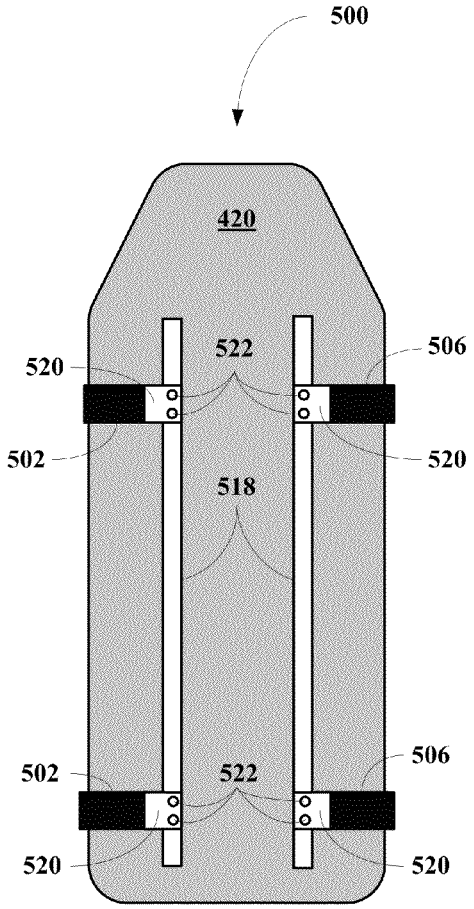

Referring now to FIGS. 5A&B, the straps 422 and 426 are shown to be seat belt type straps. The straps include a first strap segment 502 having a first connector 504. The straps include a second strap segment 506 having a second connector 508. The first connector 504 is adapted to receive the second connector 508 to form a connection 510 and to lock the second connector 508 into the first connector 504. The first connector 504 includes a release button 512, which releases the connector 508 as that the connections between the connectors may be broken. The second connector 508 includes an aperture 514 used to lock the second connector into the first connector 504. The first strap segments 502 are adjustable by pulling on the strap ends 516 (making the straps shorter) or by pulling up on the first connectors 504 (making the strap larger), while the second strap segment 506 is non-adjustable. In FIG. 5A, one strap 422 is shown in its closed state, while the other strap 426 is shown in an opened state. The strap segments 502 and 506 are affixed to anchor members 518 affixed to or integral with the back support 420 via tabs 520 held onto the anchor members 518 via bolts 522. It should be recognized that the straps may be of any form, provided that the straps are adjustable and may be lockable to accommodate different sizes and shapes of the users using the apparatus 400.

The new embodiments may include all of the features of all of the embodiments of the apparatus, the frame assembly, the forearm support assembly and the feedback units set forth in FIGS. 1A-3G and their associated description sections. The apparatuses of FIGS. 1A-F may also include a pivotally mounted front horizontal member on which the feedback up is mounted so that the apparatuses of FIGS. 1A-F surround the user. The apparatuses of FIGS. 1A-F may also include the back support member of FIGS. 4A&B.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

We claim:

1. A mobility assistance apparatus comprising:

a frame assembly including a plurality of vertical members, horizontal members, and joints, where the frame assembly forms a three-sided enclosure or a four-sided enclosure, a locomotion assembly disposed on bottom ends of some or all of the vertical members of the frame assembly, a forearm support assembly including two forearm support units mounted on two upper horizontal members of the frame assembly, where the units are adapted to fix a user's elbows at an angle of about 90° to the vertical and distribute a user's weight over the two forearm units, and a kinematic feedback assembly mounted on one of the horizontal members, wherein the kinematic feedback assembly includes a feedback unit, a plurality of sensors and wires for connecting the sensors to the feedback unit, wherein the plurality of sensors include two weight monitors mounted on the upper horizontal members from which the forearm support units are hung via a unit/monitor connector connected to a monitor/unit connector, where the connection is detachable or non-detactable, and wherein the apparatus provides mobility assistance, while providing motion feedback data that is adapted to monitor a patient's use of the apparatus.

2. The apparatus of claim 1, wherein the plurality of sensors further include a velocity monitor associated with the locomotion assembly and optionally a distance monitor associated with the locomotion assembly or feedback assembly.

3. The apparatus of claim 1, wherein the feedback unit comprises a housing including a processing unit including a memory, operating system and communications hardware and software, a cable connector, and a visual assembly, where the housing is mounted on a horizontal member of the frame assembly at a height for ease of reading by a user.

4. The apparatus of claim 3, wherein the visual assembly includes a plurality of indicator lights, and/or a visual display for user feedback.

5. The apparatus of claim 3, wherein the feedback unit further includes an audio assembly including a speaker or a speaker and a microphone for interactive feedback.

6. The apparatus of claim 3, wherein the feedback unit further includes wireless communication hardware and software to permit feedback, audio and/or visual data, information, or signals to be sent to and received from a remote site, where the data, information or signal is adapted to permit remote monitoring of a patient's progress, exercise and usage protocols, or for providing instructions to the patient for proper use of the apparatus, for changing exercise or usage protocols.

7. The apparatus of claim 1, wherein the frame assembly is non-collapsible.

8. The apparatus of claim 1, wherein the frame assembly is collapsible.

9. The apparatus of claim 1, wherein the frame assembly is non-adjustable.

10. The apparatus of claim 1, wherein the frame assembly is adjustable.

11. The apparatus of claim 1, wherein the plurality of vertical members of the frame assembly comprise two U-shaped members with their U-turns disposed upward.

12. The apparatus of claim 1, further comprising a back support member including a lumbar support and cervical support to improve upright ambulatory posture, where supports are adjustable to accommodate different users.

13. A mobility assistance apparatus comprising:

a frame assembly including two U-shape vertical members, a plurality of horizontal bracing members, a plurality of horizontal back members, a pivoting front member, and a plurality of joints, where the frame assembly forms a four-sided enclosure, when the pivoting front member is positioned in its closed state, a locomotion assembly including a plurality of translational units disposed on ends of the two vertical members, each unit includes a rotatable member mounted in a housing including a locomotion/frame connector adapted to detachably engage frame/locomotion connectors disposed on some or all of the vertical members of the frame assembly, a forearm support assembly that includes two forearm support units mounted on two upper horizontal members of the frame assembly, where the units are adapted to fix a user's elbows at an angle of about 90° to the vertical and distribute a user's weight over the two forearm units, a kinematic feedback assembly mounted on one of the horizontal members, where the kinematic feedback assembly includes a feedback unit, a plurality of sensors and wires for connecting the sensors to the feedback unit, and a back support member that includes a lumbar support and cervical support to improve upright ambulatory posture, where the lumbar and cervical supports are adjustable to accommodate different users, wherein the apparatus provides mobility assistance, while providing motion feedback data, that is adapted to monitor a patient's use of the apparatus.

14. The apparatus of claim 13, wherein each forearm support unit includes a forearm support.

15. The apparatus of claim 13, wherein the feedback unit comprises a housing including a processing unit including a memory, operating system and communications hardware and software, a cable connector, and a visual assembly, where the housing is mounted on a horizontal member of the frame assembly at a height for ease of reading by a user.

16. The apparatus of claim 15, wherein the visual assembly includes a plurality of indicator lights, and/or a visual display for user feedback.

17. The apparatus of claim 15, wherein the feedback unit further includes an audio assembly including a speaker or a speaker and a microphone for interactive feedback.

18. The apparatus of claim 15, wherein the feedback unit further includes wireless communication hardware and software to permit feedback, audio and/or visual data, information, or signals to be sent to and received from a remote site, where the data, information or signal is adapted to permit remote monitoring of a patient's progress, exercise and usage protocols, or for providing instructions to the patient for proper use of the apparatus, for changing exercise or usage protocols.

19. The apparatus of claim 13, wherein the frame assembly is non-collapsible.

20. The apparatus of claim 13, wherein the frame assembly is collapsible.

21. The apparatus of claim 13, wherein the frame assembly is non-adjustable.

22. The apparatus of claim 13, wherein the frame assembly is adjustable.

23. The apparatus of claim 13, wherein the vertical members of the frame assembly comprise two U-shaped members with their U-turns disposed upward.

24. The apparatus of claim 1, wherein the locomotion assembly comprises a plurality of translational units, each unit including a rotatable member mounted in a housing including a locomotion/frame connector adapted to detachably engage frame/locomotion connectors disposed on some or all of the plurality of vertical members of the frame assembly.

* * * * *